US008662654B2

(12) United States Patent
Onishi

(10) Patent No.: US 8,662,654 B2
(45) Date of Patent: Mar. 4, 2014

(54) PRINTING DEVICE AND PRINTING METHOD

(75) Inventor: Hiroyuki Onishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 340 days.

(21) Appl. No.: 12/882,705

(22) Filed: Sep. 15, 2010

(65) Prior Publication Data

US 2011/0096131 A1 Apr. 28, 2011

(30) Foreign Application Priority Data

Oct. 28, 2009 (JP) ..... 2009-248110

(51) Int. Cl.
*B41J 2/01* (2006.01)
*B41J 29/38* (2006.01)
*B41J 2/16* (2006.01)

(52) U.S. Cl.
USPC ..... 347/102; 347/16; 347/51

(58) Field of Classification Search
None
See application file for complete search history.

(56) References Cited

U.S. PATENT DOCUMENTS 7,244,021 B2 7/2007 Arai
7,510,277 B2 * 3/2009 Konno et al. ..... 347/102
2004/0189772 A1 * 9/2004 Arai ..... 347/102
2008/0079795 A1 * 4/2008 Nakazawa ..... 347/102
2008/0225100 A1 9/2008 Kumagai
2009/0085999 A1 * 4/2009 Furukawa ..... 347/102
2009/0167794 A1 7/2009 Hosono et al.
2011/0096130 A1 4/2011 Onishi

FOREIGN PATENT DOCUMENTS

JP 2000-158793 A 6/2000
JP 2004-306591 A 11/2004
JP 2005-193645 A 7/2005
JP 2005-199563 A 7/2005
JP 2006-088529 A 4/2006
JP 2008-221650 A 9/2008

* cited by examiner

*Primary Examiner* — Stephen Meier
*Assistant Examiner* — Alexander C Witkowski
(74) *Attorney, Agent, or Firm* — Nutter McClennen & Fish LLP; John J. Penny, Jr.; Christina M. Sperry

(57) ABSTRACT

A printing device includes a plurality of heads ejecting ink cured by irradiation of light and arranged in a transport direction of a medium, a plurality of temporary curing light sources provided respectively corresponding to the plurality of heads and respectively irradiating light for temporary curing to dots formed on the medium by the respective heads, and a main curing light source irradiating light for main curing to the dots to which the plurality of temporary curing light sources have irradiated the light, wherein the printing device has a first printing mode where a clear ink is ejected from a head placed at the upper stream in the transport direction when seen from heads ejecting color inks, and a second printing mode where the clear ink is ejected from a head placed at the lower stream in the transport direction when seen from the heads ejecting the color inks.

15 Claims, 10 Drawing Sheets

| HEAD | 31a | 31b | 31c | 31d | 31e | 31f |
|---|---|---|---|---|---|---|
| FIRST PRINTING MODE | CL | K | Y | M | C | B |
| SECOND PRINTING MODE | W | K | Y | M | C | CL |

| HEAD | 31a | 31b | 31c | 31d | 31e | 31f |
|---|---|---|---|---|---|---|
| INK COLOR | CL | K | Y | M | C | CL |
| FIRST PRINTING MODE | ○ | ○ | ○ | ○ | ○ | × |
| SECOND PRINTING MODE | × | ○ | ○ | ○ | ○ | ○ |

PRINTING DEVICE AND PRINTING METHOD

CROSS REFERENCES TO RELATED APPLICATIONS

The present invention contains subject matter related to Japanese Patent Application No. 2009-248110 filed in the Japanese Patent Office on Oct. 28, 2009, the entire contents of which are incorporated herein by reference.

BACKGROUND

1. Technical Field

The present invention relates to a printing device and a printing method.

2. Related Art

Printing devices are known in which a printing is performed by the use of liquid (for example, ultraviolet ink) which is cured due to irradiation of light (a type of electromagnetic waves, for example ultraviolet rays). In such a printing device, ink from the nozzles of a head is ejected on a medium and then light is irradiated to the dots formed on the medium. In this way, since the dots are cured to be fixed to the medium, a good printing can be performed on a medium in which it is difficult to absorb liquid (for example, refer to JP-A-2000-158793).

In the above-described printing device, there has been proposed a method for performing two-step curing. For example, light with lower irradiation energy is irradiated immediately after forming the dots, thereby suppressing bleeding between inks or dot spread (temporary curing). Thereafter, light with higher irradiation energy is irradiated to the temporarily cured dots. Thereby, the dots are completely cured (main curing).

However, in the printing device, in the case where a clear ink is used, if the clear ink is always cured under the same conditions, there is a problem in that image quality may be deteriorated.

SUMMARY

An advantage of some aspects of the invention is to improve image quality.

According to an aspect of the invention, there is a printing device including a plurality of heads ejecting ink cured by irradiation of light and arranged in a transport direction of a medium; a plurality of temporary curing light sources provided respectively corresponding to the plurality of heads and respectively irradiating light for temporary curing to the dots formed on the medium by the respective heads; and a main curing light source irradiating light for main curing to the dots to which the plurality of temporary curing light sources have irradiated the light, wherein the printing device has a first printing mode where a clear ink is ejected from a head placed in the upper stream in the transport direction when seen from heads ejecting color inks, and a second printing mode where the clear ink is ejected from a head placed at the lower stream in the transport direction when seen from the heads ejecting the color inks, and wherein the irradiation energy of the light irradiated by the temporary curing light source corresponding to the head ejecting the clear ink in the second printing mode is smaller than the irradiation energy of the light irradiated by the temporary curing light source corresponding to the head ejecting the clear ink in the first printing mode.

Other features of the invention will be shown throughout the specification and the accompanying drawings.

BRIEF DESCRIPTION OF THE DRAWINGS

The invention will be described with reference to the accompanying drawings, wherein like numbers reference like elements.

FIG. 2 is seen from the top.

DESCRIPTION OF EXEMPLARY EMBODIMENTS

Figure 1:
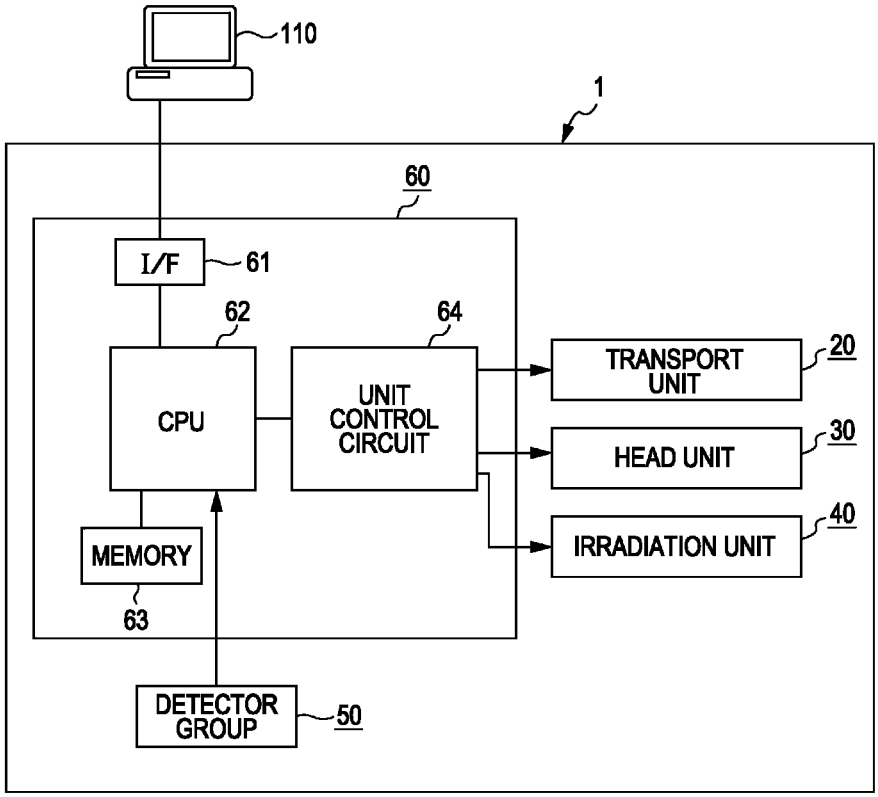
FIG. 1 is a block diagram illustrating an entire configuration of a printer.

At least the following points will become apparent through the description of this specification and the accompanying drawings.

According to an aspect of the invention, there is a printing device including a plurality of heads ejecting ink cured by irradiation of light and arranged in a transport direction of a medium, a plurality of temporary curing light sources provided respectively corresponding to the plurality of heads and respectively irradiating light for temporary curing to dots formed on the medium by the respective heads, and a main curing light source irradiating light for main curing to the dots to which the plurality of temporary curing light sources have irradiated the light, wherein the printing device has a first printing mode where a clear ink is ejected from a head placed in the upper stream in the transport direction when seen from heads ejecting color inks, and a second printing mode where the clear ink is ejected from a head placed at the lower stream in the transport direction when seen from the heads ejecting the color inks, and wherein the irradiation energy of the light irradiated by the temporary curing light source corresponding to the head ejecting the clear ink in the second printing mode is smaller than the irradiation energy of the light irradiated by the temporary curing light source corresponding to the head ejecting the clear ink in the first printing mode.

According to the printing device, it is possible to improve an image quality.

The printing device may further have a plurality of cartridges containing inks cured by irradiation of light and respectively mounted so as to be attachable and detachable, wherein the first printing mode or the second printing mode may be selected by changing each of the cartridges.

According to the printing device, it is possible to automatically set the printing modes by changing the cartridges.

In the printing device, each of the plurality of cartridges preferably includes a storage element which stores information for the type of ink contained in the cartridge.

According to the printing device, it is possible to read the information for the ink contained in the cartridge by installing the cartridge.

In the printing device, ink ejected from each of the plurality of the heads may be predetermined for each head.

According to the printing device, the first printing mode and the second printing mode can be simply changed.

In the printing device, it is preferable that the head ejecting the clear ink in the first printing mode does not eject the clear ink in the second printing mode, and the head ejecting the clear ink in the second printing mode does not eject the clear ink in the first printing mode.

According to the printing device, it is possible to respectively perform the first printing mode and the second printing mode by changing the head ejecting the clear ink.

In the printing device, it is preferable that the clear ink is used to increase adhesion of color images formed by the color inks and the medium in the first printing mode, and the clear ink is used to process a surface of the color images in the second printing mode.

According to the printing device, it is possible to suppress the bleeding between the color images and the clear ink in the first printing mode, and it is possible to make the surface even in the second printing mode.

In the following embodiments, a printing device will be described by exemplifying a line printer (a printer 1).

First Embodiment

Configuration of a Printer

Figure 2:
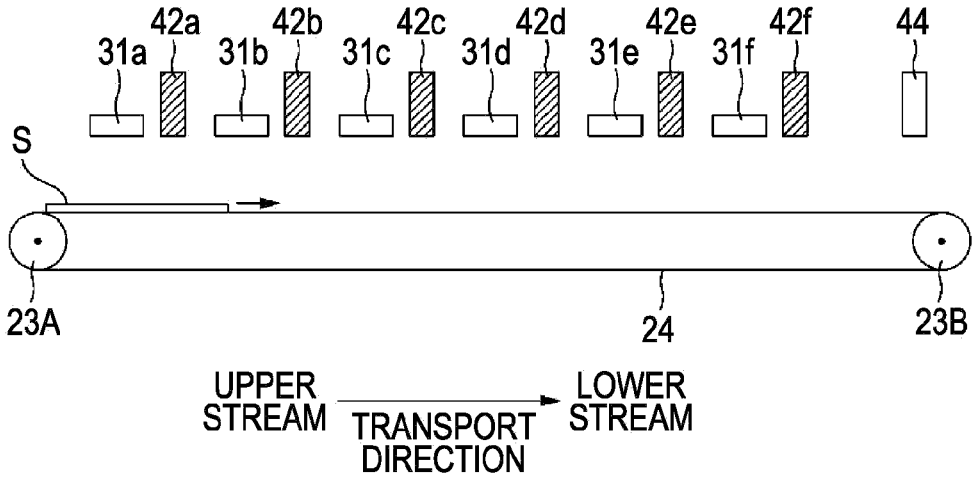
FIG. 2 is a schematic diagram illustrating the vicinity of a printing area.
Figure 3:
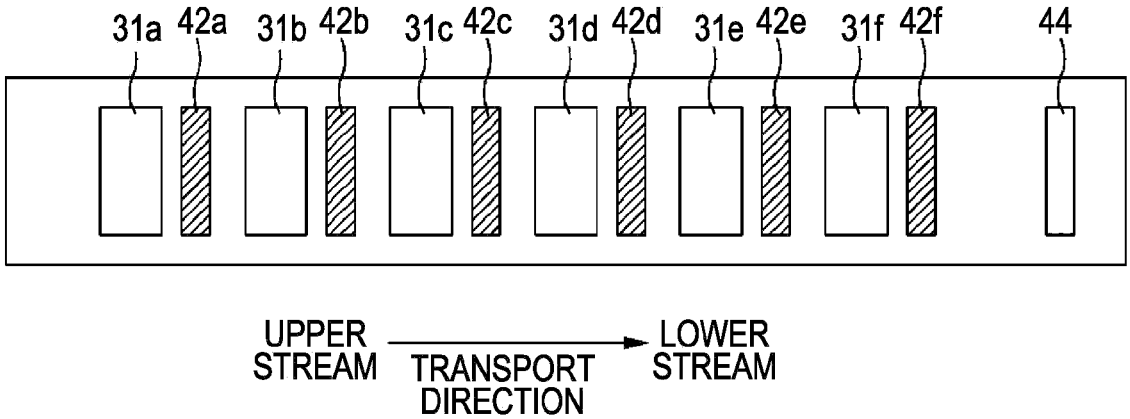
FIG. 3 is a diagram where

FIG. 1 is a block diagram illustrating an entire configuration of a printer 1. FIG. 2 is a schematic diagram illustrating the vicinity of a printing area, and FIG. 3 is a diagram where FIG. 2 is seen from the top.

A printer 1 is a printing device which prints images on media such as paper, fabric, film, or the like, and is communicably connected to a computer 110 which is an external device.

A printer driver is installed in the computer 110. The printer driver is a program which converts image data output from application programs into printing data by displaying a user interface in a display device (not shown). The printer driver is recorded on a recording medium (computer-readable recording medium) such as a flexible disc (FD), a CD-ROM, or the like. Also, the printer driver may be downloaded to the computer 110 via the Internet. The program is constituted by codes for implementing various kinds of function.

The computer 110 outputs printing data corresponding to images to be printed to the printer 1, such that the printer 1 prints the images.

The printer 1 in this embodiment is a device which prints images on a medium by ejecting an ultraviolet cured ink (hereinafter, referred to as a UV ink), as an example of a liquid, which is cured by the irradiation of ultraviolet rays (hereinafter, UV). The UV ink contains ultraviolet cured resins, and the irradiation of the UV causes the photopolymerization reaction to occur in the ultraviolet cured resins, thereby curing the UV ink.

The printer 1 in this embodiment includes a transport unit 20, a head unit 30, an irradiation unit 40, a detector group 50, and a controller 60. The printer 1, which receives printing data from the computer 110 that is an external device, controls the respective units (the transport unit 20, the head unit 30, and the irradiation unit 40) through the controller 60, and prints images on a medium based on the printing data. The controller 60 controls the respective units based on the printing data received from the computer 110, and prints images on a medium. A detector group 50 checks a situation in the printer 1, and the detector group 50 outputs a detected result to the controller 60. The controller 60 controls the respective units based on the detected result output from the detector group 50.

The transport unit 20 transports a medium (for example, paper or the like) in a predetermined direction (hereinafter, referred to as a transport direction). The transport unit 20 includes an upper stream side transport roller 23A, a lower stream side transport roller 23B, and a belt 24. When a transport motor (not shown) rotates, the upper stream side transport roller 23A and the lower stream side transport roller 23B rotate, and thereby the belt 24 rotates. The medium fed by a paper feed roller (not shown) is transported to a printable area (an area facing heads) by the belt 24. The belt 24 transports the medium, and this moves the medium in the transport direction with respect to the head unit 30. The medium passing through the printable area is discharged to the outside by the belt 24. The medium in the course of the transport is electrostatic-adsorbed or vacuum-adsorbed to the belt 24.

The head unit 30 ejects the UV inks onto the medium. In addition, in the following embodiments, the UV inks employ color inks (cyan, magenta, yellow, black, blue) used to form images, a colorless clear ink, and a white ink for a background image.

In this embodiment, as shown in FIGS. 2 and 3, there are provided six heads (heads 31*a* to 31*f*) arranged in the transport direction. Each of the heads ejects ink onto the medium during transport to form dots on the medium, and thereby images are formed on the medium. In addition, as shown in FIG. 2, the heads are arranged in order of the head 31*a*, the head 31*b*, the head 31*c*, the head 31*d*, the head 31*e*, and the head 31*f* from the upper stream side in the transport direction, and the respective heads eject inks with colors different from each other. The printer 1 in this embodiment is a line printer, and each head of the head unit 30 can form dots as wide as the medium at one time.

The irradiation unit 40 irradiates the UV towards the UV inks landing on the medium. The dots formed on the medium are cured by the irradiation of the UV from the irradiation unit 40. The irradiation unit 40 in this embodiment includes temporary curing irradiation sections 42*a* to 42*f* and a main curing irradiation section 44 which perform, for the dots formed on the medium, a two-step curing (UV irradiation) of a temporary curing and a main curing.

The temporary curing irradiation sections 42*a* to 42*f* irradiate the UV for temporarily curing the dots formed on the medium. In addition, in this embodiment, the temporary curing is for suppressing bleeding between the UV inks or the spread of dots.

The temporary curing irradiation section 42*a* is disposed at the lower stream side in the transport direction when seen from the head 31*a*, and the temporary curing irradiation section 42*b* is disposed at the lower stream side in the transport direction when seen from the head 31*b*. In addition, the temporary curing irradiation section 42*c* is disposed at the lower stream side in the transport direction when seen from the head 31*c*, and the temporary curing irradiation section 42*d* is disposed at the lower stream side in the transport direction when seen from the head 31*d*. The temporary curing irradiation section 42*e* is disposed at the lower stream side in the transport direction when seen from the head 31*e*, and the temporary curing irradiation section 42*f* is disposed at the lower stream side in the transport direction when seen from the head 31*f*.

The length in the wide direction of the medium in each of the temporary curing irradiation sections is equal to or more than the width of the medium. The respective temporary curing irradiation sections irradiate the UV to the dots formed by the respective corresponding heads of the head unit 30.

The temporary curing irradiation sections 42*a* to 42*f* in this embodiment have light emitting diodes (LEDs) as light sources for irradiation of the UV. The irradiation energy of the LEDs can be easily changed by controlling the magnitude of the input current. The wavelengths of the LEDs range from 375 nm to 420 nm in both the temporary curing and the main curing.

The main curing irradiation section 44 irradiates the UV for the main curing of the dots formed on the medium. In this embodiment, the main curing is for completely curing the dots, and the amount of the UV irradiation in the main curing is greater than the amount of the UV irradiation in the temporary curing.

The main curing irradiation section 44 is provided at the lower stream side in the transport direction when seen from the temporary curing irradiation section 42*f*. In addition, the length in the wide direction of the medium in the main curing irradiation section 44 is more than the width of the medium. The main curing irradiation section 44 irradiates the UV for main curing to the dots which have been formed by the respective heads and temporarily cured by the respective temporary curing irradiation sections.

The main curing irradiation section 44 in this embodiment includes a lamp (a metal halide lamp, mercury lamp, or the like) as a light source for the UV irradiation. An LED may be employed as the light source for the main curing irradiation section 44.

The detector group 50 includes a rotary type encoder (not shown), a paper detection sensor (not shown), etc. The rotary type encoder detects the amount of rotation in the transport roller 23A at the upper stream side or in the transport roller 23B at the lower stream side. It is possible to detect the amount of the medium transported based on the detected result of the rotary type encoder. The paper detection sensor detects a position of a front end of the medium during feeding.

The controller 60 is a control unit (control section) which controls the printer. The controller 60 includes an interface section 61, a CPU 62, a memory 63, and a unit control circuit 64. The interface section 61 performs transmission and reception of data between the computer 110 which is an external device and the printer 1. The CPU 62 is an operational processing device which controls the entire printer. The memory 63 is an area for storing programs of the CPU 62 or is for securing a working area, and includes storage elements such as RAM, EEPROM or the like. The CPU 62 controls the respective units via the unit control circuit 64, according to the programs stored in the memory 63.

Processing by the Printer Driver

Figure 4:
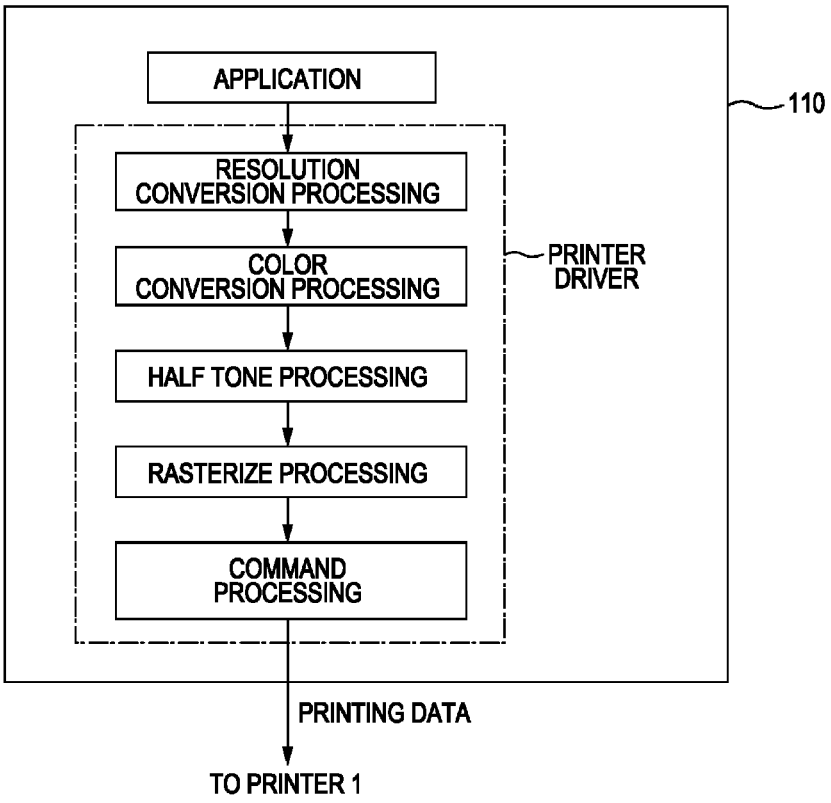
FIG. 4 is a flowchart of a processing performed by a printer driver at the time of printing.

FIG. 4 is a flowchart illustrating processing performed by the printer driver when the printer 1 performs a printing.

The printer driver receives image data from application programs, converts it into printing data of a format which can be analyzed by the printer 1, and outputs the printing data to the printer. When converting the image data from the application programs into the printing data, the printer driver performs a resolution conversion processing, a color conversion processing, a half tone processing, a rasterization processing, a command addition processing, and so on. Hereinafter, various types of processing performed by the printer driver will be described.

The resolution conversion processing is processing where the image data (text data, image data, or the like) output from the application programs is converted into data with a resolution (printing resolution) when the printing is performed on paper. For example, when the printing resolution is designated as 720×720 dpi, the image data of a vector format received from the application programs is converted into image data of bit map format with a resolution of 720×720 dpi. Data for each pixel of the image data after the resolution conversion processing is multiple grayscale (for example, 256 grayscales RGB data) represented by an RGB color space.

The color conversion processing is a processing where the RGB data is converted into data in a color space, corresponding to colors of the inks forming images. For example, when the images are printed by the use of CMYK inks, the RGB data is converted into data in the CMYK color space. The color conversion processing in this case is performed based on a table (a color conversion look-up table (LUT)) where grayscale values of the RGB data correspond to grayscale values of the CMYK data. In addition, in this case, pixel data after the color conversion processing is CMYK data of 256 grayscales represented by the CMYK color space.

The half tone processing is a processing where data with a high number of grayscales is converted into data with grayscales which can be formed by the printer. For example, by the half tone processing, data with 256 grayscales is converted into one bit data with 2 grayscales or two bit data with 4 grayscales. In the half tone processing, the dither method, the gamma correction, the error diffusion method, or the like is used. The data which has undergone the half tone processing has the same resolution as the printing resolution (for example, 720×720 dpi). In the image data after the half tone processing, each pixel corresponds to pixel data of one bit or two bits, and thus the pixel data is data indicating the conditions of dot formation in each pixel (presence or absence of the dots, sizes of the dots).

The rasterization processing is processing where the pixel data arranged in a matrix is rearranged in an order to be transmitted to the printer 1 for each pixel data. For example, the pixel data is rearranged according to an arrangement order of nozzles in each nozzle line.

The command addition processing is processing where command data corresponding to a printing type is added to the data which has undergone the rasterization processing. As the command data, for example, there is transport data indicating a transport speed of the medium.

The printing data generated via such processing is transmitted to the printer 1 by the printer driver.

Printing Operation

When the printer 1 receives the printing data from the computer 110, the controller 60 first enables a paper feed roller (not shown) to rotate by the transport unit 20 so that a medium to be printed is sent on the belt 24. The medium is transported at a constant speed on the belt 24 without stopping, and passes under the head unit 30 and the irradiation unit 40. During that time, the controller 60 enables dots to be formed on the medium by continuously ejecting ink from the nozzles of each head of the head unit 30, and at the same time enables each irradiation section of the irradiation unit 40 to irradiate the UV thereto. For example, the controller 60 enables the ink to be ejected from the head 31*a* when the medium passes under the head 31*a*. In addition, the temporary curing irradiation section 42*a* irradiates the UV for temporary curing to the medium when the medium which has passed the head 31*a* passes under the temporary curing irradiation section 42*a*. Thereby, the dots formed on the medium by the head 31*a* are temporarily cured. Subsequently, in the same manner, the ink is ejected from each head and thereafter the temporary curing irradiation section 42 corresponding to each head irradiates the UV for temporary curing according as the medium is transported in the transport direction. Finally, the main curing irradiation section 44 irradiates the UV for main curing to the medium when the medium passes under the main curing irradiation section 44. Thereby, the dots formed on the medium are completely cured. This causes images to be printed on the medium. The controller 60 discharges the medium where the images are printed.

Ink

In the printer, subtractive mixture are used to represent various colors. Primary colors in the subtractive mixture colors are three colors of cyan C, magenta M, and yellow Y. The cyan C absorbs red R and reflects green G and blue B. The magenta M absorbs green G and reflects red R and blue B. The yellow Y absorbs blue B and reflects red R and green G. That is to say, the cyan ink, the magenta ink, and the yellow ink represent images to be viewed by adjusting the amount of RGB absorbed, which are three primary colors of light. Hereinafter, the cyan ink, the magenta ink, and the yellow ink are also referred to as C ink, M ink, and Y ink, respectively.

In the printer 1 in this embodiment, the color ink also uses black ink (hereinafter, also referred to as K ink) and blue ink (hereinafter, also referred to as B ink) in addition to the CMY inks. As the color ink, red ink, green ink, metallic ink, violet ink or the like may be used.

The use of the K ink is because even when the three colors of CMY are mixed, strong black (deep black) cannot be represented.

In addition, the reason for using the B ink is as follows.

For example, in a landscape photograph, it is important to represent the clear blue of the sky. In this case, if the blue ink (hereinafter, also referred to as B ink) is used, it is possible to represent clear blue.

In the following description, dots formed by the color inks are also referred to as color dots.

In this embodiment, a clear ink (hereinafter, also referred to as a CL ink) and a white ink (hereinafter, also referred to as a W ink) are used as well. In addition, in the following description, dots formed by the CL ink are also referred to as clear dots, and dots formed by the W ink are also referred to as background dots.

The W ink is a white ink for printing a background color (white) of color images, for example, when the printing is performed on a transparent medium. As such, the background is white, and thereby the color images are easily viewed.

The CL ink is colorless and clear ink which may be used for coating a surface (hereinafter, referred to as a surface coating) or increasing adhesion of the color inks to the medium (hereinafter, referred to as an anchor coating). The CL ink does not contain pigments and thus is easily attached to the medium as compared with the color inks. For this reason, rather than directly forming color dots on a medium where the color inks are not easily attached, forming the color dots after clear dots are formed on the medium results in better adhesion of the color dots to the medium.

As such, the CL ink used for both the surface coating and the anchor coating has, for example, the following composition.

An Example of the CL Ink Composition
phenoxyethyl acrylate 30%
acrylic acid 2-(2-vinyloxyethoxy)ethyl 15%
tripropylene glycol diacrylate 15%
dipropylene glycol diacrylate 15%
vinyl caprolactam 10%
dicyclopentenyl acrylate 11.45%
Urethane oligomer 4%
Photopolymerization initiator (IRGACURE819) 4%
Photopolymerization initiator (DAROCURE TPO) 4%
Photopolymerization initiator (IRGACURE 127) 1%
Heat polymerization inhibitor (MEHQ) 0.05%
Surfactant (BYK-UV3500) 0.5%

Each ink is contained in an attachable and detachable cartridge (described later) of the printer 1 body, such a cartridge is mounted on each head, and thus corresponding ink is ejected from each head. That is to say, the cartridge mounted on the head is changed (exchanged), and thereby the ink ejected from each head can be changed.

Nozzle Arrangement of Each Head

Figure 5:
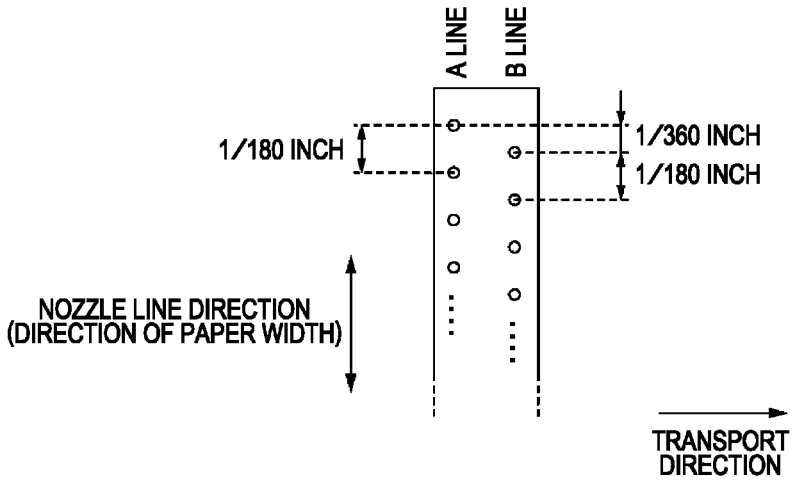
FIG. 5 is a diagram illustrating the nozzle arrangement in each head.

FIG. 5 is a diagram illustrating a nozzle arrangement of each head. Each head is provided with two nozzle lines, "A line" and "B line" as shown in the figure.

The nozzles in each line are arranged at an interval of 1/180 inch in the direction (direction of the nozzle line) intersecting the transport direction. A position in the direction of the nozzle line of the nozzles in the A line and a position in the direction of the nozzle line of the nozzles in the B line are misaligned with each other by an amount of half a nozzle pitch (1/360 inch). Thereby, each color dot can be formed in a resolution of 1/360 inch.

Configuration of the Head

A configuration of the head will be described.

Figure 6:
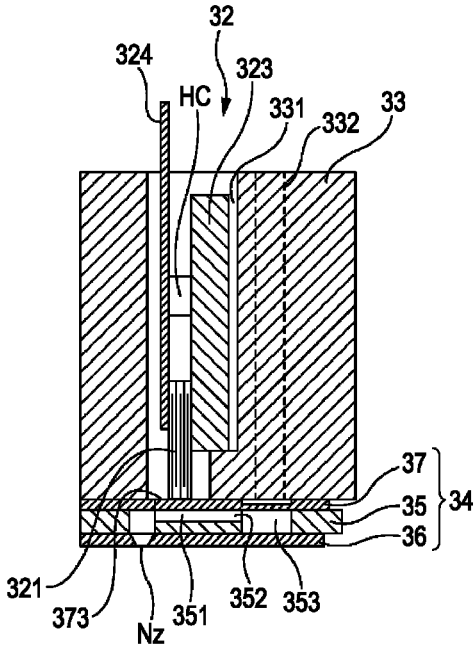
FIG. 6 is a sectional view of the head.

FIG. 6 is a sectional view of the head. FIG. 6 shows a sectional view of one nozzle among the nozzles shown in FIG. 5. As shown in the figure, the head includes a driving unit 32, a case 33 storing the driving unit 32, and a flow path unit 34 installed in the case.

The driving unit 32 includes a piezoelectric element group constituted by a plurality of piezoelectric elements 321, a fixing plate 323 for fixing the piezoelectric element group, and a flexible cable 324 for transmitting signals to each of the piezoelectric elements 321. Each piezoelectric element 321 is installed in the fixing plate 323 in a so-called cantilever state. The fixing plate 323 is a plate-shaped member with a rigidity which can receive a reactive force from the piezoelectric element 321. The flexible cable 324 is a flexible sheet type wire substrate which is electrically connected to the piezoelectric element 321 in a lateral side of a fixed end section opposite to the fixing plate 323. A head controller HC, which is a control IC for controlling the operation or the like of the piezoelectric element 321, is disposed on the surface of the flexible cable 324.

The case 33 has a cuboid block shape appearance including a storage space 331 which can store the driving unit 32. The above-described flow path unit 34 is joined to the front end face of the case 33. The storage space 331 is of a size so that the driving unit 32 can be exactly fitted thereto. In addition, the case 33 is also provided with an ink supply tube 332 which supplies ink from a corresponding cartridge (described later) to the flow path unit 34.

The flow path unit 34 includes a flow path formation substrate 35, a nozzle plate 36, and an elastic plate 37. The flow path formation substrate 35, the nozzle plate 36, and the elastic plate 37 are constructed as a single body by inserting the flow path formation substrate 35 between the nozzle plate 36 and the elastic plate 37 and stacking them together. The nozzle plate 36, which is a thin plate made of stainless steel, is provided with the nozzle Nz.

In the flow path formation substrate 35, a plurality of empty sections, which become pressure rooms 351 and ink supply holes 352, is formed corresponding to the respective nozzles Nz. A reservoir 353 is a liquid reservoir for supplying ink reserved in the cartridge to each pressure room 351, and is communicated with the other end of the pressure room 351 via the ink supply hole 352. The ink supplied from the cartridge is introduced into the reservoir 353 via the ink supply tube 332.

In the driving unit 32, the free end section of the piezoelectric element 321 is inserted into the storage space 331 in the state where the free end section is toward the flow path unit 34 side, and the front end face of the free end section is attached to a corresponding island section 373. A rear face of the fixing plate 323 is attached to an inner wall of the case which partitions the storage space 331. When driving signals are supplied to the piezoelectric element 321 via the flexible cable 324 in this storage state, the piezoelectric element 321 increases and decreases volume of the pressure room 351 by expansion and contraction. This volume change in the pressure room 351 causes the ink within the pressure room 351 to alter its pressure. Thereby, it is possible to jet ink drops from a corresponding nozzle Nz by using the change of the ink pressure.

Configuration of Cartridge and Cartridge Attachment Section

Figure 7:
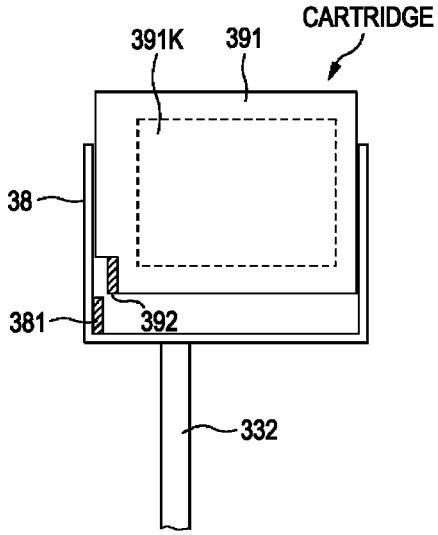
FIG. 7 is a schematic diagram illustrating a structure of a cartridge and a cartridge attachment section.

FIG. 7 is a schematic diagram illustrating a cartridge and an example of a structure of a cartridge attachment section 38. The cartridge attachment section 38 is provided corresponding to each of the heads. That is to say, the cartridge is installed in each head. The configuration of the cartridge and the cartridge attachment section 38 for each head are all the same, and thus one of them will be described. Schemes for mounting the cartridge may be a scheme where the cartridge is mounted on the head (on-carriage scheme), or a scheme where the cartridge is mounted (on the printer body) apart from the head and the ink is supplied to the head from the cartridge via the tube (off-carriage scheme).

In FIG. 7, the cartridge includes a cartridge main body 391 which constitutes an ink container 391K containing UV ink therein, and a storage element 392 provided in a side frame of the cartridge body 391. The storage element 392 is an element which transmits and receives various kinds of data to and from the printer 1 (controller 60) when the cartridge is installed in the cartridge attachment section 38 of the printer 1 body, and is constituted by an element capable of storing various kinds of data, for example, a non-volatile memory such as a flash memory. In addition, a plurality of connection terminals (not shown) is exposed from a surface of the storage element 392.

On the other hand, the cartridge attachment section 38 is provided with a connector 381 disposed at the inner wall of the cartridge attachment section 38. The connector 381 is provided with a plurality of connection terminals (not shown) which is respectively electrically connected to the plurality of connection terminals of the storage element 392 when the cartridge attachment section 38 is installed with the cartridge.

When the cartridge is installed in the cartridge attachment section 38, the ink can be supplied to the head from the ink container 391K of the cartridge via the ink supply tube 332. In addition, when the cartridge is installed in the cartridge attachment section 38, the plurality of connection terminals of the storage element 392 of the cartridge and the plurality of connection terminals of the connector 381 of the cartridge attachment section 38 are electrically connected to each other, and thus data can be transmitted and received between the printer 1 (controller 60) and the storage element 392.

The storage element 392 stores information indicating characteristics, for example, a color, a concentration, a viscosity, or the like of ink contained in a corresponding cartridge, or various kinds of printing control programs or the like. The storage element 392 may store information for the time of generating ink (cartridge), information for the time of installing the cartridge, or the like.

As such, in this embodiment, the cartridge is installed in the cartridge attachment section 38 of the printer 1, and thereby the printer 1 (controller 60) can read information for the cartridge from the storage element 392.

Temporary Curing and Main Curing

In this embodiment, dots are cured by irradiating the UV to the UV ink landing on the medium. In the printer 1 in this embodiment, the irradiation unit 40 includes the temporary curing irradiation sections 42*a* to 42*f* which temporarily harden the UV ink by the UV irradiation, and the main curing irradiation section 44 which performs the main curing of the UV ink by the UV irradiation, so as to perform the two-step curing. In addition, the temporary curing is for suppressing bleeding between the UV inks landing on the medium or the spread of dots, and the main curing is for completely curing the UV ink. For this reason, the irradiation energy of the UV in the main curing is greater than that of the UV in the temporary curing. The irradiation energy ($mJ/cm^2$) of the UV corresponds to irradiation intensity ($mW/cm^2$)×time (sec). Specifically, the irradiation energy of the UV in the temporary curing ranges from 3 to 30 $mJ/cm^2$ (preferably, 5 to 15 $mJ/cm^2$), whereas the irradiation energy of the UV in the main curing ranges from 200 to 500 $mJ/cm^2$.

As above, the temporary curing controls bleeding between the UV inks landing on the medium or the dot spread, and thus shapes of the dots are almost completely set by the temporary curing.

Figure 8A:
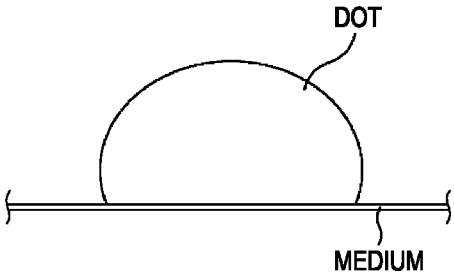
FIGS. 8A to 8C are diagrams illustrating relationships between shapes of ultraviolet inks landing on a medium and ultraviolet irradiation energy of the temporary curing.
Figure 8B:
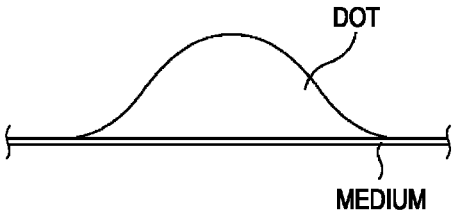
Figure 8C:
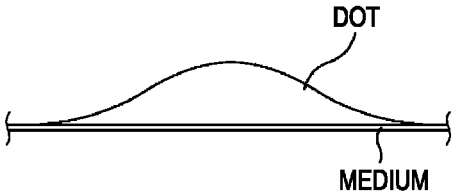

FIGS. 8A to 8C are diagrams illustrating relationships between shapes of the UV inks (dots) landing on the medium, and the UV irradiation energy in the temporary curing. The UV irradiation energy is decreased in the order of FIG. 8A, FIG. 8B, and FIG. 8C.

When the UV irradiation energy in the temporary curing is high, for example, the shape of the dot is as shown in FIG. 8A. In this case, the bleeding between the inks or the dot spread can be suppressed, but since the unevenness of a surface of the medium is increased due to the dots, gloss is deteriorated.

In contrast, a case where the UV irradiation energy in the temporary curing is low, for example, is as shown in FIG. 8C. In this case, gloss becomes better. However, the spreading between other inks is easily generated, and the dot spread becomes large.

Printing Processing in the First Embodiment

As described above, in this embodiment, ink supplied to each head can be changed depending on a cartridge installed in the cartridge attachment section 38 of the printer 1.

Figures 9, 10:
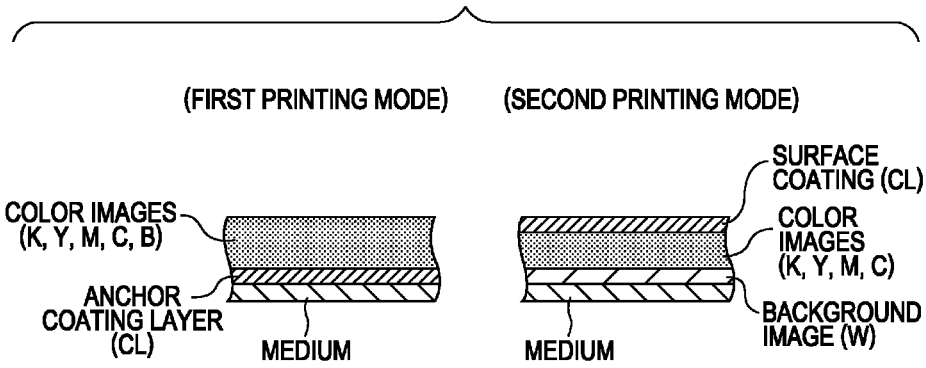
FIG. 9 is a table illustrating relationships between printing modes and inks in a first embodiment.
FIG. 10 is a diagram illustrating images formed by the printing modes in the first embodiment.

FIG. 9 is a table illustrating relationships between printing modes and inks in the first embodiment. FIG. 10 shows diagrams illustrating images formed in the printing mode in the first embodiment.

As shown in FIG. 9, in a first printing mode, five color inks (K ink, Y ink, M ink, C ink, and B ink) and the CL ink are used to form images. For example, a cartridge for the CL ink is installed in the cartridge attachment section 38 corresponding to the head 31*a*. Thus, the CL ink is ejected from the head 31*a*. In addition, for example, a cartridge for the B ink is installed in the cartridge attachment section 38 corresponding to the head 31*f*. Thus, the B ink is ejected from the head 31*f*.

In the first printing mode, the CL ink is first ejected from the head 31*a* placed in the uppermost stream in the transport direction. Thereby, as shown in FIG. 10, a clear dot (anchor coating layer) is formed on the medium. This anchor coating layer is for increasing the adhesion of color images formed later to the medium. Thereafter, the color images are formed on the anchor coating layer by respectively ejecting the five color inks (the K ink, the Y ink, the M ink, the C ink, and the B ink) from the heads 31*b* to 31*f*. Also, although not described here, after the inks are ejected from the respective heads, the UV for temporary curing is irradiated by associated temporary curing irradiation sections so as to perform the temporary curing immediately after the dots are formed. This is the same for the following description.

On the other hand, in a second printing mode, four color inks (the K ink, the Y ink, the M ink, and the C ink), the W ink, and the CL ink are used. For example, a cartridge for the W ink is installed in the cartridge attachment section 38 corresponding to the head 31*a*. Thus, the W ink is ejected from the head 31*a*. In addition, for example, a cartridge for the CL ink is installed in the cartridge attachment section 38 corresponding to the head 31*f*. Thus, the CL ink is ejected from the head 31*f*.

As shown in FIG. 10, in the second printing mode, a white background image is initially formed on the medium by the W ink. Thereafter, the C ink, the M ink, the Y ink, and the K ink form color images on the background image, and the CL ink forms a surface coating layer thereon.

The controller 60 can detect types (colors) of cartridges mounted in the respective heads and select corresponding printing modes, by reading information from the storage element 392. The controller 60 transmits the read information to the printer driver of the computer 110. The printer driver creates printing data corresponding to each of the printing modes and transmits it to the printer 1. In this way, in this embodiment, it is possible to automatically change the printing modes by changing the cartridges.

In the case of the second printing mode, since the head 31*f* ejecting the CL ink is placed at the lower stream in the transport direction when seen from the other heads 31*a* to 31*e*, the CL ink is ejected later than the other color inks. However, in the second printing mode, when the CL ink is temporarily cured under the same conditions as the other inks, there is a problem in that the surface is made uneven and thus the image quality is deteriorated (refer to FIGS. 8A to 8C). Accordingly, in this embodiment, when the CL ink is used for the surface coating (when the CL dots are formed later than the other color dots), the UV irradiation energy for temporary curing of the CL dots is lowered.

Figure 11:
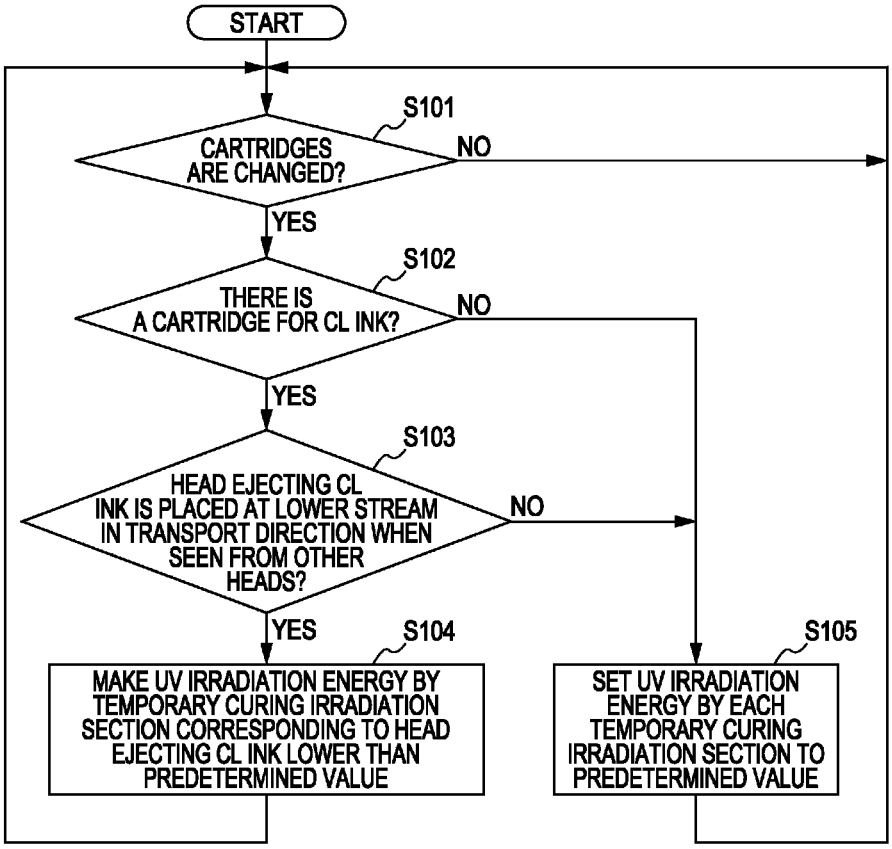
FIG. 11 is a flowchart of a process at the time of changing inks in the first embodiment.

FIG. 11 is a flowchart illustrating processing at the time of changing inks in the first embodiment.

To begin with, the controller 60 determines whether or not a cartridge corresponding to each of the heads is changed (S101). When determining that the cartridge is changed (YES at step S101), the controller 60 determines whether or not there is a cartridge for the CL ink among the installed cartridges (S102).

When it is determined that there is a cartridge for the CL ink (YES at step S102), it is determined whether a head installed with the cartridge for the CL ink is placed at the lower stream in the transport direction when seen from the other heads ejecting the color inks (S103). When determining that the cartridge for the CL ink is placed at the lower stream in the transport direction when seen from the other heads ejecting the color inks (YES at step S103), the controller 60 makes the UV irradiation energy of the temporary curing irradiation section corresponding to the head ejecting the CL ink, lower than a predetermined value (S104). That is to say, the UV irradiation energy of the temporary curing irradiation section corresponding to the head ejecting the CL ink is made lower than the UV irradiation energy of the other temporary curing irradiation sections. Thereafter, the process returns to step S101.

When, at step S102, it is determined that there is no cartridge for the CL ink (NO at step S102), and when, at step S103, the head installed with the cartridge for the CL ink is determined not to be placed at the lower stream in the transport direction when seen from the other heads ejecting the color inks (NO at step S103), the irradiation energy of each of the temporary curing irradiation sections is set to a predetermined value (S105), and then the process returns to step S101.

For example, in FIG. 9, in the first printing mode, the head ejecting the CL ink is placed at the upper stream in the transport direction when seen from the other heads ejecting the color inks, and thus the result is determined to be negative (NO) at step S103. Therefore, the irradiation energy of each of the temporary curing irradiation sections is set to a predetermined value. When the first printing mode is changed to the second printing mode, the cartridge for the CL ink of the head 31*a* is changed to a cartridge for the W ink, and furthermore the cartridge for the B ink of the head 31*f* is changed to the cartridge for the CL ink. If the controller 60 detects that the cartridge for the CL ink is installed, it determines whether the head (head 31*f*) installed with the cartridge for the CL ink is placed at the lower stream in the transport direction when seen from the other heads ejecting the color inks. In the second printing mode, the head 31*f* is placed at the lower stream in the transport direction when seen from the other heads ejecting the color inks, and thus the result is determined to be affirmative (YES) at step S103. Thereby, the controller 60 lowers the UV irradiation energy of the temporary curing irradiation section 42*f* by reducing the current input to the light source (LED) of the temporary curing irradiation section 42*f* corresponding to the head 31*f*. In this case, the UV irradiation energy for temporary curing of the CL ink (clear dot) is lowered; however, the color inks ejected earlier onto the medium have already been cured, therefore there is little risk of bleeding between the color dots and the clear dot. In addition, since the UV irradiation energy for temporary curing of the clear dot is lowered, a surface of the surface coating layer formed by the clear dot becomes even to improve gloss.

In this way, it is possible to suppress spreading when the CL ink is used for the anchor coating and to improve gloss when the CL ink is used for the surface coating. Therefore, it is possible to effectively use the CL ink for each of the anchor coating and the surface coating, and to improve the image quality in each case.

Although the irradiation energies for temporary curing of the respective color inks are the same (a predetermined value), the irradiation energy may be set to a value suitable for the temporary curing of each color ink. For example, the K ink is scarcely cured as compared with the other color inks, and thus the UV irradiation energy for temporary curing by the temporary curing irradiation section corresponding to the head ejecting the K ink may be increased.

In addition, in this embodiment, although the UV irradiation energy of the temporary curing irradiation section 42*f* corresponding to the head 31*f* ejecting the CL ink is lowered in the second printing mode (S104), the UV need not be irradiated from the temporary curing irradiation section 42*f*. In this case, a surface of the surface coating layer is more even and thus a gloss is also improved.

Second Embodiment

The ink ejected by each head is changed by changing the cartridges in the first embodiment, but the ink ejected by each head is fixed in the second embodiment. That is to say, each head is installed with a cartridge for a preset color. Further, the controller 60 automatically sets the printing modes by the cartridge installed in each head in the first embodiment, but, in the second embodiment, the printing modes are set, for example, by a user's input to a user interface displayed on a display device (not shown) of the computer 110.

Figures 12, 13:
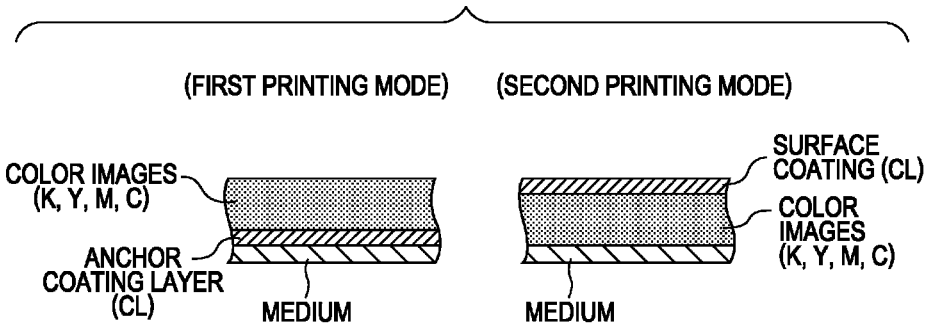
FIG. 12 is a table illustrating relationships between printing modes and inks in a second embodiment.
FIG. 13 is a diagram illustrating images formed by the printing modes in the second embodiment.

FIG. 12 is a table illustrating relationships between printing modes and inks in the second embodiment. In addition, FIG. 13 shows diagrams illustrating images formed in printing modes in the second embodiment. In FIG. 12, heads used in each printing mode are marked with O, and heads not used are marked with x.

As shown in FIG. 12, a cartridge for a corresponding color ink is installed in each head. For example, the cartridge for the CL ink is installed in the head 31*a*, and thus the CL ink is ejected from the head 31*a*. The CL ink can be ejected from the head 31*a* placed at the uppermost stream in the transport direction or from the head 31*f* placed at the lowest stream in the transport direction, among the heads of the printer 1.

In a first printing mode in the second embodiment, the controller 60 enables the heads 31*a* to 31*e* to eject the inks and the head 31*f* not to eject the ink (the CL ink).

In the first printing mode, at first, the CL ink is ejected from the head 31*a* placed at the uppermost stream in the transport direction. Thereby, as shown in FIG. 13, a clear dot (anchor coating layer) is formed on a medium. This anchor coating layer is for increasing the adhesion of color images formed later to the medium. Thereafter, the color images are printed on the anchor coating layer by respectively ejecting the four color inks (the K ink, the Y ink, the M ink, and the C ink) from the heads 31*b* to 31*e*.

In the first printing mode, the respective temporary curing irradiation sections 42*a* to 42*e* corresponding to the heads 31*a* to 31*e* irradiate the UV for temporary curing, and the temporary curing irradiation section 42*f* corresponding to the head 31*f* which does not eject ink does not irradiate the UV for temporary curing.

In a second printing mode in the second embodiment, the controller 60 enables the heads 31*b* to 31*f* to eject the inks and the head 31*a* not to eject the ink (the CL ink).

In the second printing mode, at first, the four color inks (the K ink, the Y ink, the M ink, and the C ink) are respectively ejected onto the medium from the heads 31*b* to 31*e* to print color images. The CL ink is ejected on the color images from the head 31*f* placed at the lowest stream in the transport direction. Thereby, as shown in FIG. 13, the clear dot (surface coating layer) is formed on the color images.

In the second printing mode, the respective temporary curing irradiation sections 42*b* to 42*f* corresponding to the heads 31*b* to 31*f* irradiate the UV for temporary curing, and the temporary curing irradiation section 42*a* corresponding to the head 31*a* does not irradiate the UV for temporary curing.

Figure 14:
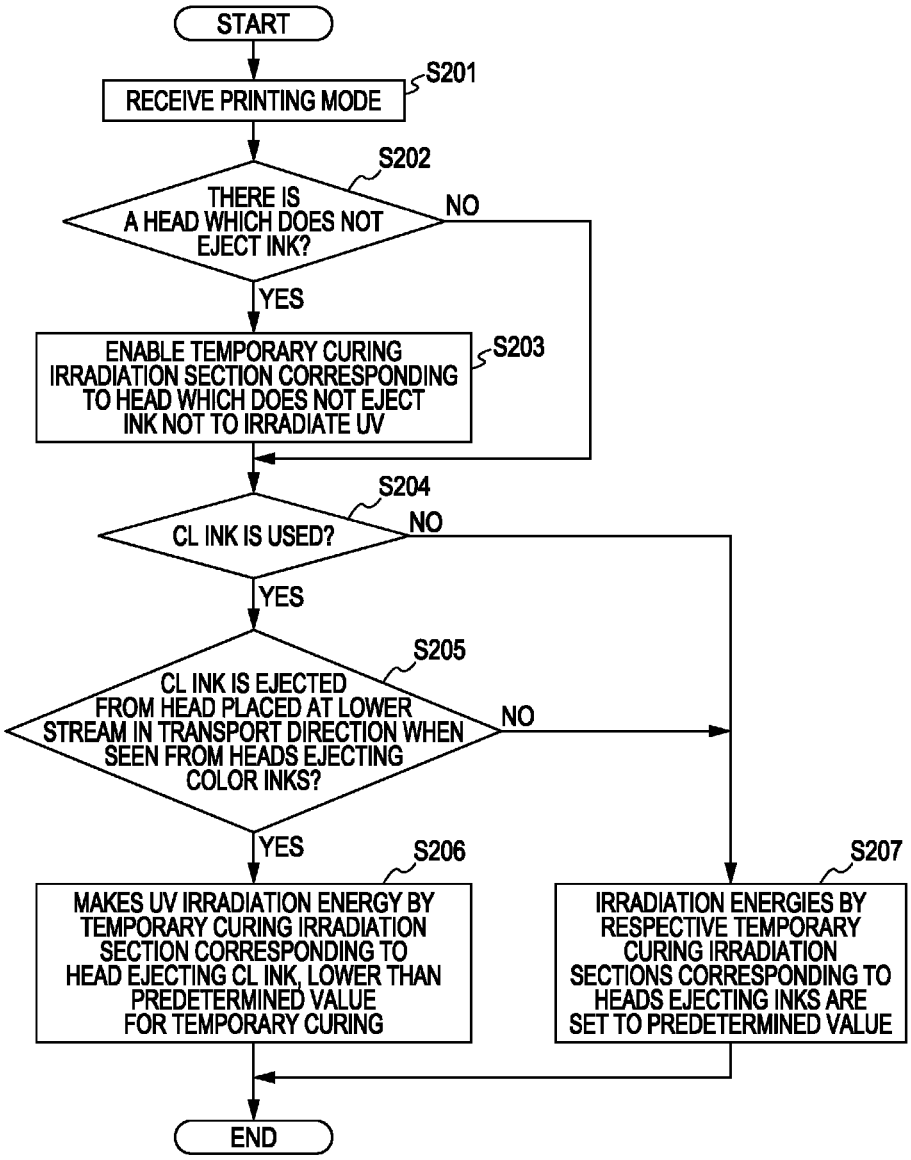
FIG. 14 is a flowchart of a process at the time of printing in the second embodiment.

FIG. 14 is a flowchart illustrating a processing at the time of printing in the second embodiment.

To begin with, the controller 60 receives a printing mode from the printer driver (S201), and determines whether or not there is a head which does not eject ink in the printing mode (S202). When there is a head which does not eject ink (YES at step S202), the controller 60 enables the temporary curing irradiation section corresponding to the head which does not eject ink not to irradiate the UV (S203). In this embodiment, there is a head which does not eject ink in either the first printing mode or the second printing mode. For example, in the case of the first printing mode, the controller 60 enables the temporary curing irradiation section 42*f* corresponding to the head 31*f* which does not eject ink, not to irradiate the UV.

When determining the result to be negative (NO) at step S202, and after step S203, the controller 60 determines whether or not the CL ink is used (S204).

When the CL ink is determined to be used (YES at step S204), it is determined whether or not the CL ink is ejected from the head placed at the lower stream in the transport direction when seen from the heads ejecting the color inks (S205). When determining that the CL ink is ejected from the head placed at the lower stream in the transport direction when seen from the heads ejecting the color inks (YES at step S205), the controller 60 makes the UV irradiation energy of the temporary curing irradiation section corresponding to the head ejecting the CL ink, lower than a predetermined value for temporary curing (S206). In other words, the UV irradiation energy of the temporary curing irradiation section corresponding to the head ejecting the CL ink is made lower than the UV irradiation energies of the other temporary curing irradiation sections.

When the CL ink is determined not to be used at step S204 (NO at step S204), and when the CL ink is determined not to be ejected from the head placed at the lower stream in the transport direction when seen from the heads ejecting the color inks at step S205 (NO at step S205), the irradiation energies of the respective temporary curing irradiation sections corresponding to the heads ejecting the inks are set to a predetermined value (S207).

For example, in the first printing mode in FIG. 12, since the CL ink is ejected from the head (head 31*a*) placed at the upper stream in the transport direction when seen from the heads ejecting the color inks, the result is determined to be negative (NO) at step S205 in FIG. 14, and the UV irradiation energies of the temporary curing irradiation sections corresponding to the respective heads ejecting the inks are set to the same value (the predetermined value) (S207). In contrast, in the second printing mode, since the CL ink is ejected from the head (head 31*f*) placed at the lower stream in the transport direction when seen from the heads ejecting the color inks, the result is determined to be affirmative (YES) at step S205 in FIG. 14, and the irradiation energy of the temporary curing irradiation section 42*f* corresponding to the head 31*f* is set to a value lower than a predetermined value (S206). That is to say, the UV irradiation energy for temporary curing of the CL ink (surface coating layer) in the second printing mode is smaller than the UV irradiation energy for temporary curing of the CL ink (anchor coating layer) in the first printing mode. In this way, in the same manner as the first embodiment, it is possible to suppress bleeding between the color inks and the CL ink, and it is possible to make a surface of the surface coating layer formed by the CL ink even and to improve gloss in the second printing mode where the spreading scarcely occurs.

In the second embodiment, the cartridges are not required to be changed in order to change the printing modes unlike the first embodiment, but the first printing mode and the second printing mode can be changed by only changing the head ejecting the CL ink. Therefore, the printing modes can be easily changed.

Other Embodiments

Although the printer or the like has been described as an embodiment, the above-described embodiments are for better understanding of the invention and are not to be construed as limiting the invention. The invention may be modified and changed without departing from the scope thereof and moreover includes the equivalents thereof. Particularly, embodiments described below are included in the invention.

Printer

In the above-described embodiments, although the printer has been described as a printing device, it is not limited thereto. For example, techniques the same as the above-described embodiments may be applied to various types of devices which employ ink jet techniques, such as a color filter fabrication device, a dyeing device, a micro fabrication device, a semiconductor fabrication device, a surface processing device, a three dimensional modeling device, a liquid evaporation device, an organic EL fabrication device (particularly, a polymer EL fabrication device), a display fabrication device, a film formation device, a DNA chip fabrication device, or the like.

Although the printer has been the line printer in the above-described embodiment, it is not limited thereto. For example, there may be a printer where a plurality of heads and a plurality of temporary curing irradiation sections are alternately provided opposite to a circumferential surface of a cylindrical transport drum, and a main curing irradiation section is provided at the lowest stream in the transport direction. In this case as well, it is possible to set irradiation conditions of the temporary curing irradiation sections in the same manner as the above-described embodiments.

Ink

In the above-described embodiments, the nozzles eject the ink (UV ink) cured by the irradiation of ultraviolet rays (UV). However, liquid ejected from the nozzles is not limited to the ink cured by the UV light, but may be ink cured by visible rays. In this case, each irradiation section irradiates visible rays with wavelengths for curing the ink.

Although cyan, magenta, yellow, black, and blue inks have been used as the color inks in this embodiment, inks of other colors (for example, orange, green, red, or the like) may be used.

The Number of Heads

Although the number of the heads (and the corresponding temporary curing irradiation sections) is six in the above-described embodiments, it is not limited thereto. For example, the number of the heads (and the corresponding temporary curing irradiation sections) may be equal to or less than five or equal to or more than seven. In addition, although one head is used for one color ink in the above-described embodiments, it is not limited thereto but a plurality of heads may be used for one color ink.

Printer Driver

The processing by the printer driver in FIG. 4 may be performed in the printer side. In this case, the printing device is constituted by the printer and a personal computer where the printer driver is installed.

The entire disclosure of Japanese Patent Application No. 2009-248110, filed Oct. 28, 2009 is expressly incorporated by reference herein.

What is claimed is:

1. A printing device comprising:

a plurality of heads ejecting ink cured by irradiation of light and arranged in a transport direction of a medium;

a plurality of temporary curing light sources provided respectively corresponding to the plurality of heads and respectively irradiating light for temporary curing to dots formed on the medium by the respective heads; and a main curing light source irradiating light for main curing to the dots to which the plurality of temporary curing light sources have irradiated the light, wherein the printing device has a first printing mode that includes ejecting a clear ink from one of the heads placed at an upper stream in the transport direction of the heads ejecting color inks, irradiating the temporary curing light to the clear ink by one of the temporary curing light sources corresponding to the one of the heads that discharges the clear ink, discharging, from one of the heads for discharging color inks, a color ink on the temporary cured clear ink, and irradiating the temporary curing light to the color ink by one of the temporary curing light sources corresponding to the one of the heads that discharges the color ink, wherein the printing device has a second printing mode that includes discharging a color ink from one of the heads for discharging color inks, irradiating the temporary curing light to the color ink discharged in the in the second printing mode by one of the temporary curing light sources corresponding to the one of the heads that discharges the color ink in the second printing mode, ejecting the clear ink on the color ink temporary cured in the second printing mode from one of the heads placed at the lower stream in the transport direction of the heads ejecting the color inks, and irradiating the temporary curing light to the clear ink discharged in the second printing mode by one of the temporary curing light sources corresponding to the one of the heads that discharges the clear ink in the second printing mode, and wherein an irradiation energy of the light irradiated by the one of the temporary curing light sources corresponding to the one of the heads that ejects the clear ink in the second printing mode is smaller than the irradiation energy of the light irradiated by the one of the temporary curing light sources corresponding to the one of the heads that ejects the clear ink in the first printing mode.

2. The printing device according to claim 1, further comprising a plurality of cartridges containing inks cured by irradiation of light and respectively mounted so as to be attachable and detachable, wherein the first printing mode or the second printing mode is selected by changing each of the cartridges.

3. The printing device according to claim 2, wherein each of the plurality of cartridges includes a storage element which stores information for a type of ink contained in the cartridge.

4. The printing device according to claim 1, wherein ink ejected from each of the plurality of the heads is predetermined for each head.

5. The printing device according to claim 4, wherein the head ejecting the clear ink in the first printing mode does not eject the clear ink in the second printing mode, and wherein the head ejecting the clear ink in the second printing mode does not eject the clear ink in the first printing mode.

6. The printing device according to claim 1, wherein the clear ink is used to increase adhesion of color images formed by the color inks and the medium in the first printing mode, and the clear ink is used to process a surface of the color images in the second printing mode.

7. The printing device according to claim 1, wherein adjacent ones of the plurality of heads each have one of the plurality of temporary curing light sources provided therebetween.

8. The printing device according to claim 7, wherein the main curing light source is provided on a lower stream side of a one of the plurality of heads positioned farthest down the lower stream in the transport direction.

9. The printing device according to claim 1, wherein each of the plurality of temporary curing light sources is configured to irradiate a same, predetermined value of irradiation energy.

10. The printing device according to claim 1, wherein each of the plurality of temporary curing light sources is configured to irradiate a value of irradiation energy based on a color of the ejected ink which the temporary curing light source is irradiating.

11. A printing method using a printing device comprising:

a plurality of heads ejecting ink cured by irradiation of light and arranged in a transport direction of a medium;

a plurality of temporary curing light sources provided respectively corresponding to the plurality of heads and respectively irradiating light for temporary curing to dots formed on the medium by the respective heads; and a main curing light source irradiating light for main curing to the dots to which the plurality of temporary curing light sources have irradiated the light, wherein the printing method has a first printing mode that includes ejecting a clear ink from one of the heads placed in an upper stream in the transport direction of the heads ejecting color inks, irradiating the temporary curing light to the clear ink by one of the temporary curing light sources corresponding to the one of the heads that discharges the clear ink, discharging, from one of the heads for discharging color inks, a color ink on the temporary cured clear ink, and irradiating the temporary curing light to the color ink by one of the temporary curing light sources corresponding to the one of the heads that discharges the color ink, wherein the printing method has a second printing mode that includes discharging a color ink from one of the heads for discharging color inks, irradiating the temporary curing light to the color ink discharged in the in the second printing mode by one of the temporary curing light sources corresponding to the one of the heads that discharges the color ink in the second printing mode, ejecting the clear ink on the color ink temporary cured in the second printing mode from one of the heads placed at the lower stream in the transport direction of the heads ejecting the color inks, and irradiating the temporary curing light to the clear ink discharged in the second printing mode by one of the temporary curing light sources corresponding to the one of the heads that discharges the clear ink in the second printing mode, and wherein an irradiation energy of the light irradiated by the one of the temporary curing light sources corresponding to the one of the heads that ejects the clear ink in the second printing mode is smaller than the irradiation energy of the light irradiated by the one of the temporary curing light sources corresponding to the one of the heads that ejects the clear ink in the first printing mode.

12. The printing method according to claim 11, wherein adjacent ones of the plurality of heads each have one of the plurality of temporary curing light sources provided therebetween.

13. The printing method according to claim 12, wherein the main curing light source is provided on a lower stream side of a one of the plurality of heads positioned farthest down the lower stream of the transport direction.

14. The printing method according to claim 11, wherein each of the plurality of temporary curing light sources irradiates a same, predetermined value of irradiation energy.

15. The printing method according to claim 11, wherein each of the plurality of temporary curing light sources irradiates a value of irradiation energy based on a color of the ejected ink which the temporary curing light source is irradiating.

* * * * *